United States Patent [19]

Yagi et al.

[11] Patent Number: 4,697,942

[45] Date of Patent: Oct. 6, 1987

[54] RIBBON SHIFTING DEVICE FOR A PRINTING APPARATUS

[75] Inventors: Takashi Yagi; Yoshiharu Horii; Yasuo Domoto, all of Shizuoka, Japan

[73] Assignee: Tokyo Electric Co., Ltd., Tokyo, Japan

[21] Appl. No.: 847,472

[22] Filed: Apr. 3, 1986

[30] Foreign Application Priority Data

Apr. 8, 1985 [JP] Japan ..... 60-73782
Apr. 8, 1985 [JP] Japan ..... 60-73783

[51] Int. Cl.[4] ..... B41J 32/00; B41J 35/14

[52] U.S. Cl. ..... 400/208; 400/216.1

[58] Field of Search ..... 400/216, 216.1, 216.2, 400/216.3, 216.4, 227.2, 211, 212, 213, 213.1, 215, 215.1, 215.2, 215.3, 215.4, 207, 208, 208.1, 163

[56] References Cited

U.S. PATENT DOCUMENTS 4,425,046 1/1984 Van Horne et al. ..... 400/212 X

FOREIGN PATENT DOCUMENTS 56-50658 5/1981 Japan ..... 400/215
58-79355 5/1983 Japan ..... 400/215
73986 4/1984 Japan ..... 400/216.4
194884 11/1984 Japan ..... 400/212

*Primary Examiner*—Charles A. Pearson
*Attorney, Agent, or Firm*—Oblon, Fisher, Spivak, McClelland, & Maier

[57] ABSTRACT

A ribbon shifting device has a cassette holder for holding a multicolor ribbon cassette, which is moved in a predetermined direction by a cam. The cam is driven by a driving means through a gear train consisting of at least two gears. When the cassette holder is located at the home position, a recess formed in one of the meshing gear is brought opposite to the other gear, so that the gears are disengaged, and then an urging means urges the cam in a direction to bring the gears into engagement. Thus, the adjustment of the home position of the cassette holder is achieved simultaneously, accurately and easily.

5 Claims, 13 Drawing Figures

RIBBON SHIFTING DEVICE FOR A PRINTING APPARATUS

FIELD OF THE INVENTION AND RELATED ART STATEMENT

The present invention relates to a multicolor printing apparatus which carries out multicolor printing through the impact printing system or the thermal transfer system by using an ink ribbon having a plurality of color zones and, more particularly, to a ribbon shifting device for a printing apparatus capable of shifting the ink ribbon so that an optional color zone among a plurality of color zones is positioned at the printing position.

There are known ribbon shifting devices for a printing apparatus capable of shifting the multicolor ink ribbon having a plurality of color zones for multicolor printing so that an optional color zone among the color zones is positioned at the printing position. An exemplary known ribbon shifting device has a cassette holder for detachably holding a multicolor ribbon cassette containing an ink ribbon having a plurality of color zones, and a carriage vertically swingably supporting the cassette holder. The cassette holder is turned through a gear train by a step motor. After deciding the home position of the cassette holder, the step motor acts by fixed steps to locate a desired color zone at the printing position.

This ribbon shifting device of the prior art has difficulty in matching the phase of the step motor to the home position of the cassette holder.

OBJECTS AND SUMMARY OF THE INVENTION

It is a first object of the present invention to provide a ribbon shifting device for a printing apparatus constituted so that the home position of the cassette holder thereof can be adjusted accurately.

It is a second object of the present invention to provide a ribbon shifting device for a printing apparatus capable of accurately locating an optional zone of an ink ribbon at the printing position.

It is a third object of the present invention to provide a ribbon shifting device for a printing apparatus capable of use of both a ribbon cassette for multicolor printing and a ribbon cassette for monochromatic printing.

It is a fourth object of the present invention to provide a ribbon shifting device for a printing apparatus having facility of matching the phase of the step motor to the home position of the cassette holder.

In order to achieve the above-mentioned objects, according to the present invention, a cassette holder for holding a multicolor ribbon cassette is connected to a carriage so as to be shiftable and the cassette holder is shifted widthwise of the ink ribbon contained in a ribbon cassette held on the cassette holder by means of a cam and a driving means for driving the cam. A transmission train for transmitting the power of the driving mean to the cam includes at least two gears and one of the gears is provided with a recess to disengage the meshing gears when the cassetted holder is located at the home position. The ribbon shifting device has urging means to urge the cam so that the gears are engaged.

In locating an optional color zone of the ink ribbon at the printing position, the driving means turns the cam to shift the cassette holder. When the driving means continues to operate, the cassette holder arrives finally at the home position regardless of the position of the cassette holder. Upon the arrival of the cassette holder at the home position, the recess formed in one of the meshing gears comes to a position opposite the teeth of the other, and thereby the gears are disengaged. Accordingly, the home position of the cassette holder is arranged accurately and easily by continuous motion of the driving means.

DETAILED DESCRIPTION OF THE PREFERRED EMBODIMENTS

Figure 1:
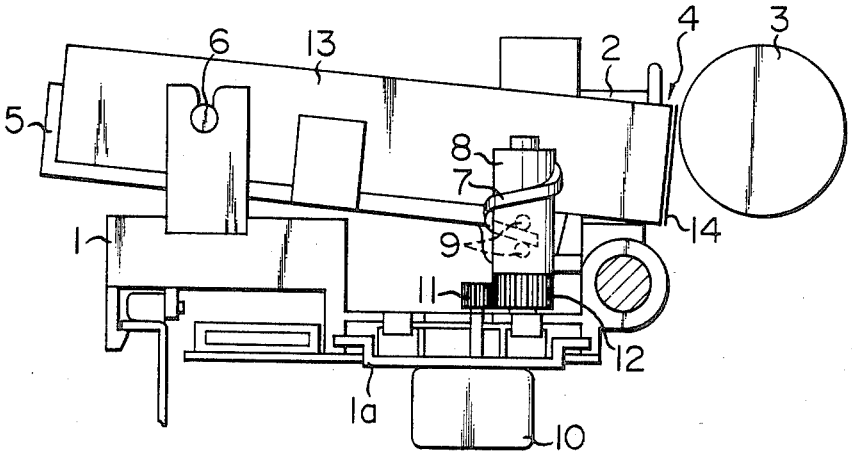
FIG. 1 is a side elevation of a ribbon shifting device, in a first embodiment, according to the present invention.
Figure 2:
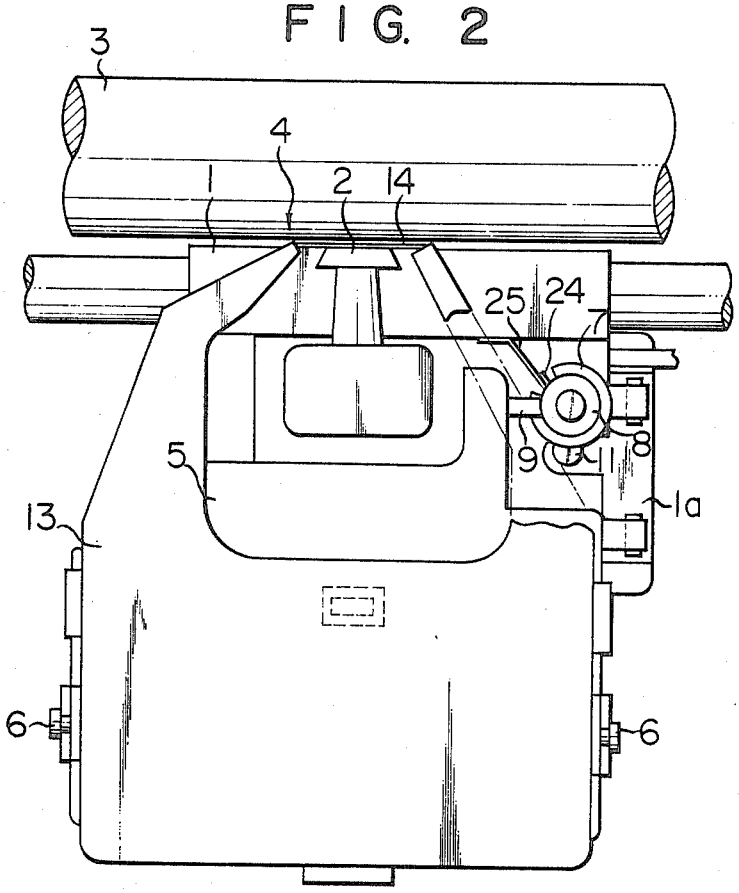
FIG. 2 is a plan view of the ribbon shifting device of FIG. 1.

A first embodiment of the present invention will be described hereinafter in connection with FIGS. 1 to 7.

In the drawings, indicated at 3 is a platen and at 1 is a carriage moveable along the longitudinal axis of the platen 3. A printing unit 4 comprises the carriage 1 and a printing head 2 mounted on the carriage 1. A cassette holder 5 is supported pivotally by pivots 6 on the carriage 1. A cam 8 having a helical thread 7 is supported rotatably on the carriage 1. The axis of rotation of the cam 8 extends vertically to the axis of turning of the carriage 1. A base plate 1*a* fixedly holding a reversible step motor 10 as a driving means is mounted detachably on the carriage 1. A pair of pins 9 project from the cassette holder 5 so as to receive the helical thread 7 of the cam 8. A gear 12 is formed in the lower end of the cam 8. A pinion 11 is fixed to the output shaft of the step motor 10 and engages the gear 12 of the cam 8. A ribbon cassette 13 containing a multicolor ink ribbon 14 having four color zones 15, 16, 17 and 18 is mounted detachably on the cassette holder 5.

Figure 4:
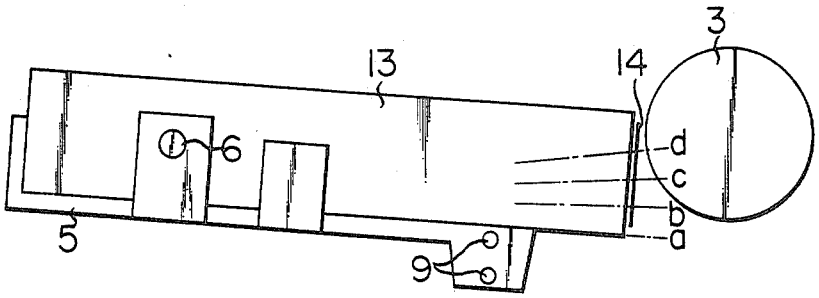
FIG. 4 is a view of assistance in explaining cassette holder shifting operation.
Figure 5:
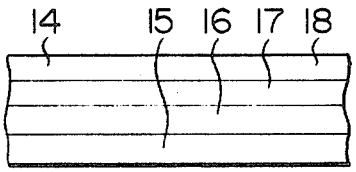
FIG. 5 is a fragmentary plan view of a ink ribbon.
Figure 6:
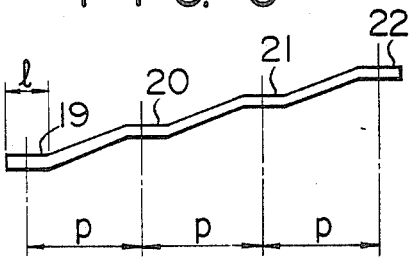
FIG. 6 is a development of the helical thread of the cam.

Referring to FIGS. 4 and 6, the helical thread 7 of the cam 8 has four stalling sections 19, 20, 21 and 22, which extend perpendicularly to the axis of rotation of the cam 8. When the pins 9 attached to the cassette holder 5 engage the stalling section 19, 20, 21 or 22, the cassette holder 5 is located at a position a, b, c or d, respectively, to locate the color zone 15, 16, 17 or 18 respectively of the multicolor ink ribbon 14 opposite to the printing unit 4. In this embodiment, the length l and the pitch p of the stalling sections 19, 20, 21 and 22 correspond to four steps and thirteen steps of turning of the step motor 10, respectively.

Some teeth of the gear 12 formed in the circumference of the cam 8 are removed to form a recess 23. When the cassette holder 5 is located at the home position, the recess 23 of the gear 12 is positioned opposite to the gear 11, so that the gears 11 and 12 are disengaged. A projection 24 is formed in the upper part of the circumference of the cam 8 so as to engage resiliently a flat spring 25 as urging means attached to the carriage 1. When the gears 11 and 12 are disengaged, the flat spring 25 turns the cam 8 through the projection 24 so as to make the gears 11 and 12 engage.

Figure 7:
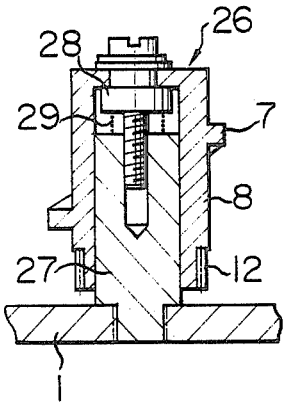
FIG. 7 is an enlarged sectional view of an adjusting mechanism.
Figure 8:
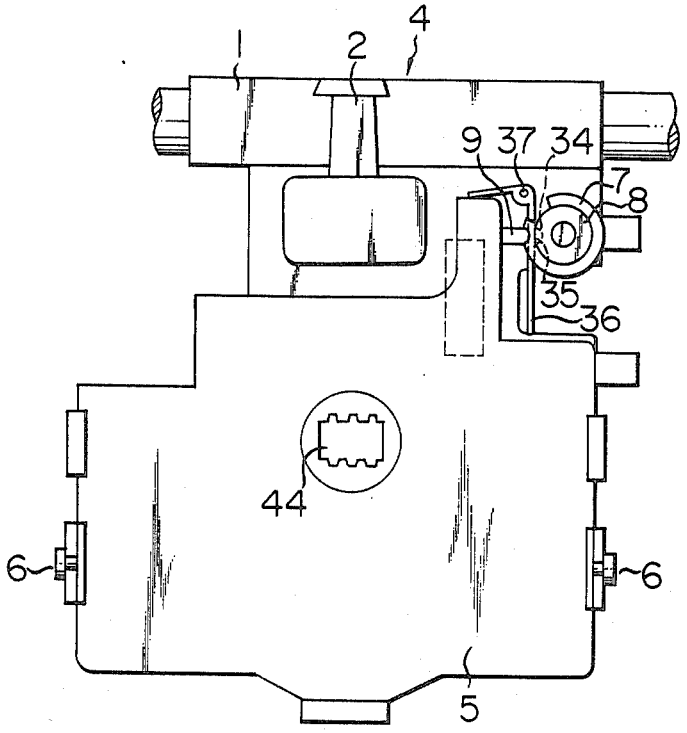
FIG. 8 is a plan view of a ribbon shifting device, in a second embodiment, according to the present invention.
Figure 9:
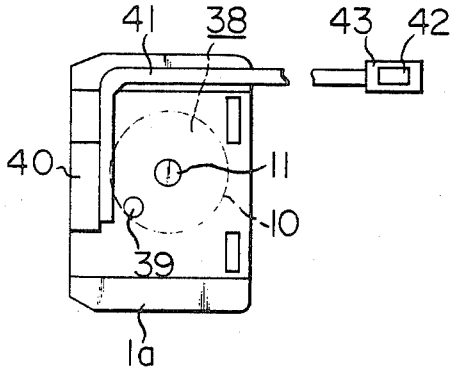
FIG. 9 is a plan view of a multicolor ribbon shifting unit.
Figure 10:
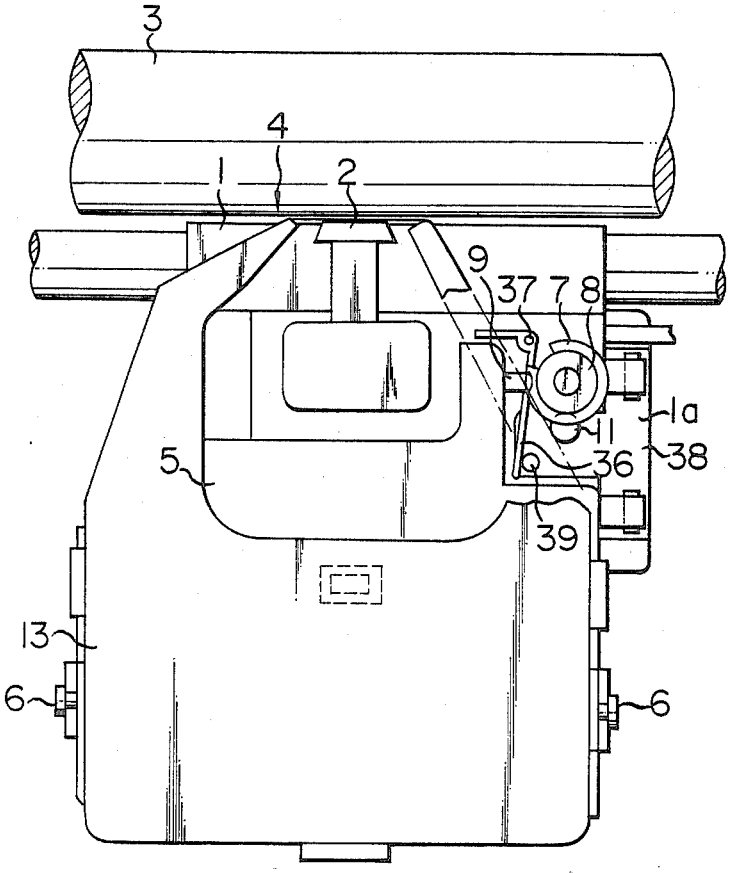
FIG. 10 is a plan view showing the multicolor ribbon shifting unit and a multicolor ribbon cassette mounted on a carriage.
Figure 11:
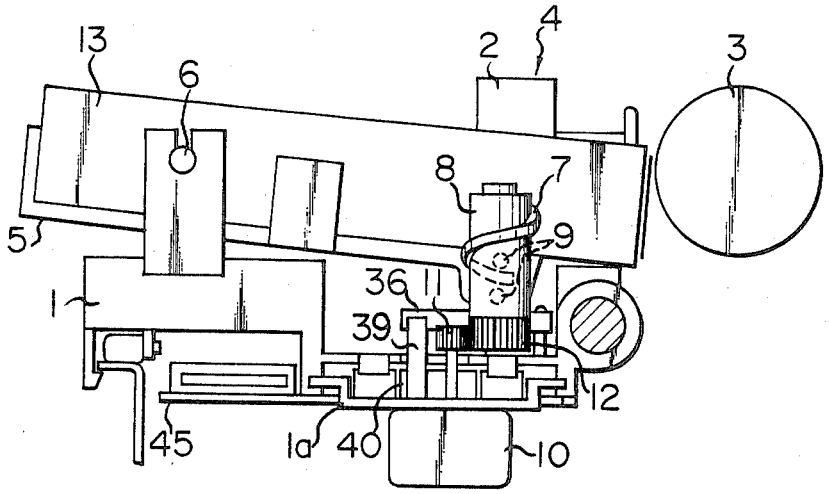
FIG. 11 is a side elevation showing the multicolor ribbon shifting unit and the multicolor ribbon cassette mounted on the carriage.
Figure 12:
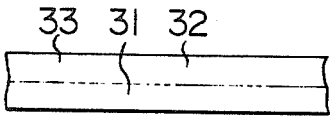
FIG. 12 is a fragmentary plan view of a monochromatic ink ribbon.
Figure 13:
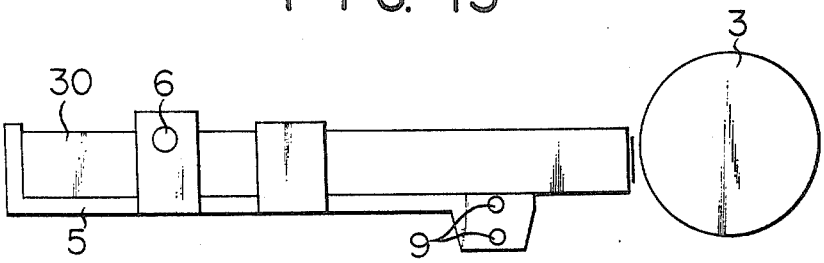
FIG. 13 is a side elevation of a monochromatic ribbon cassette located at the printing position.

Referring to FIG. 7, an adjusting mechanism 26 is formed inside the cam 8 to adjust the axial position of the cam 8. The adjusting mechanism 26 comprises a cylindrical post 27 attached to the carriage 1 and slidably holding the cam 8 thereon, an adjusting screw 28 screwed in the cylindrical post 27 to hold the cam 8 with place and a spring 29 axially urging the adjusting screw 28.

In selecting a desired color zone of the multicolor ribbon 14 for the printing operation of the printing unit 4 in a desired color, the step motor 10 is actuated to turn the cassette holder 5 on the pivots 6 in a vertical direction through the helical thread 7 of the cam and the pins 9. When the pins 9 engage the stalling section 19, 20, 21 or 22 of the helical thread 7, the cassette holder 5 is shifted to the position a, b, c or d, respectively, to locate the desired color zone 15, 16, 17 or 18 respectively, of the multicolor ink ribbon 14 opposite to the printing unit 4.

Figure 3:
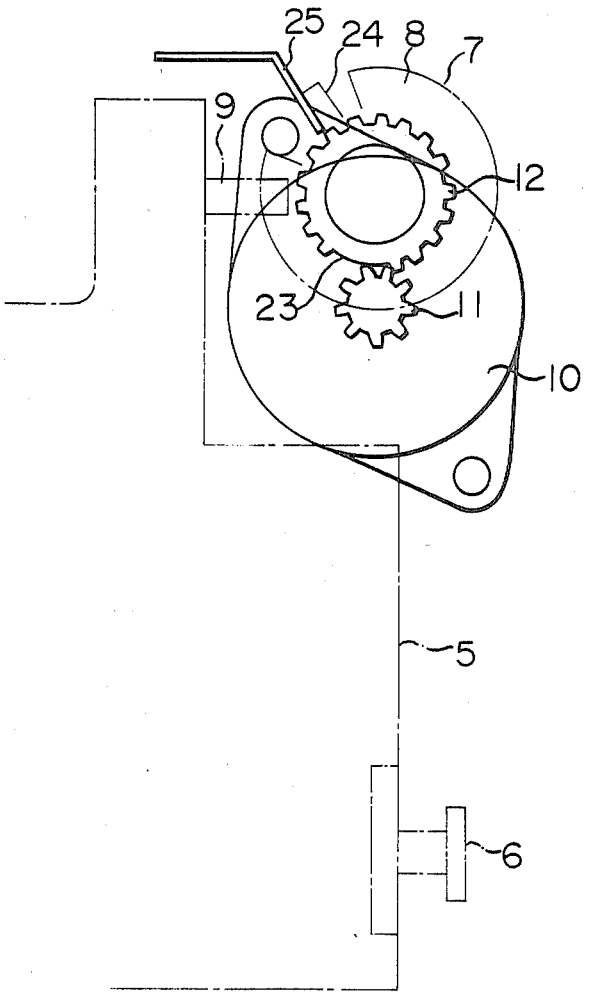
FIG. 3 is an enlarged plan view showing the relation between the cam and the step motor of the ribbon shifting device of FIG. 1.

The manner of adjusting the home position of the cassette holder 5 and the manner of matching the phase of the step motor 10 to the home position will be described hereinafter. When the pins 9 engage the stalling section 22, the cassette holder 5 is located at the position d. In this state, the step motor 10 is operated by thirty-nine steps corresponding to a distance three times the pitch p of the stalling sections to turn the cam 8 counterclockwise. Consequently, the recess 23 is brought opposite to the pinion 11, and thereby the piniton 11 and the gear 12 are disengaged as illustrated in FIG. 3. At the same time, the inertial rotation of the cam 8 is checked by the flat spring 25 and the cam 8 is stopped at a position where the first tooth of the gear 12 at the end of the recess 23 engages a tooth of the pinion 11. In this state, the pins 9 engage the stalling section 19 to locate the cassette holder 5 at the home position a. No matter where the cassette holder 5 is located, the adjustment of the home position of the cassette holder 5 and the matching of the phase of the step motor 10 to the home position can be achieved simultaneously by operating the step motor in one direction by thirty-nine or more steps.

Each of the stalling sections 19, 20, 21 and 22 has a length l corresponding to four steps of turning of the step motor 10. Accordingly, the cassette holder 5 can be located correctly at the working positions, because the position of the cassette holder 5 remains unchanged while the pins 9 engage the stalling section 19, 20, 21 or 22. Thus, the color zones 15, 16, 17 and 18 of the multicolor ink ribbon 14 can be positioned accurately opposite to the printing unit 4.

The adjusting screw 26 is turned to move the cam 8 axially on the cylindrical post 27 for the further accurate adjustment of the home position a of the cassette holder 5.

A second embodiment of the present invention will be described hereinafter in connection with FIGS. 8 to 13. Basically, the second embodiment is the same as the first embodiment, and hence the like reference characters designate like or corresponding parts through FIGS. 1 to 13 and the description of the same parts and constitution of the second embodiment as those of the first embodiment will be omitted to avoid duplication.

A cassette holder 5 employed in the second embodiment is capable of holding both a multicolor ribbon cassette 13 and a monochromatic ribbon cassette 30. The monochromatic ribbon cassette 30 contains a ribbon 33 having a zone 31 and a zone 32. The ink ribbon 33 has the form of a Möbius strip.

A recess 34 is formed in the circumfercnce of a cam 8. A detent 36 having a protrusion 35 which engages the recess 34 is supported rotatably by a shaft 37 on a carriage 1 and is urged counterclockwise.

A multicolor ribbon shifting unit 38 is mounted on a base plate 1*a*. The multicolor ribbon shifting unit 38 comprises a step motor 10, a bar-shaped unlocking member 39 engaging the detent 36, and a connector 40. When the base plate 1*a* is mounted on the carriage 1, the unlocking member 39 is located at a position where the unlocking member 39 is able to disengage the protrusion 35 of the detent 36 from the recess 34 of the cam 8. The connector 40 is connected at one end thereof through a flexible cable 41 to a multicolor ribbon detecting switch 43 provided with an actuator 42. The multicolor ribbon detecting switch 43 is placed in a pocket 44 formed in the cassette holder 5. A projection projecting from the bottom surface of the multicolor ribbon cassette 13 depresses the actuator 42 of the multicolor ribbon detecting switch 43 when the multicolor ribbon cassette 13 is mounted on the cassette holder 5. The connector 40 is fixed at the other end thereof to the bottom wall of the carriage 1 and is connected to a printed circuit board 45 connected to an external circuit.

The ribbon shifting device thus constituted is applicable to both the use of the monochromatic ribbon cassette 30 and the use of the multicolor ribbon cassette 13. When the monochromatic ribbon cassette 30 is to be mounted on the cassette holder 5, the base plate 1*a* is removed from the carriage 1. Then, the protrusion 35 of the detent 36 is fitted in the recess 34 of the cam 8 to determine the direction of rotation of the cam 8. Consequently, the cassette holder 5 is turned in a vertical plane to a position where the monochromatic ribbon cassette 30 is located properly at the printing position.

When the multicolor ribbon cassette 13 is to be mounted on the cassette holder 5, the base plate 1*a* is attached to the carriage 1. Then, the unlocking member 39 removes the protrusion 35 of the detent 36 from the recess 34 to allow all the components of the ribbon shifting device to operate in the same manner as those of the first embodiment for multicolor printing operation.

The monochromatic ribbon cassette 30 may be used with the base plate 1*a* attached to the carriage 1. In such a case, the cam 8 is rotated by the step motor 10 to shift the cassette holder 5 to a position where the monochromatic ribbon cassette 30 is located at the predetermined printing position.

What is claimed is:

1. A ribbon shifting device for a printing apparatus, comprising:

an ink ribbon having a plurality of color zones;

a multicolor ribbon cassette containing the ink ribbon;

a cassette holder for removably holding the multicolor ribbon cassette;

a carriage holding the cassette holder so that the cassette holder is shiftable widthwise of the ink ribbon;

a cam rotatably supported on the carriage to shift the cassette holder;

driving means provided on the carriage, to drive the cam for rotation in opposite directions;

power transmitting means for transmitting the power of the driving means to the cam, including at least two meshing gears;

one of the two meshing gears having a recess for disengaging the two meshing gears when the cassette holder is located at the home position; and urging means provided on the carriage, for rotatively urging the cam when the two meshing gears are disengaged so as to engage the two gears.

2. A ribbon shifting device for a printing apparatus, according to claim 1, wherein an adjusting mechanism for varying the axial position of the cam is provided on the carriage.

3. A ribbon shifting device for a printing apparatus, according to claim 1, wherein the cassette holder is capable of holding a monochromatic ribbon cassette containing a monochromatic ink ribbon as well as the multicolor ribbon cassette, a detent is provided on the carriage so as to engage the cam resiliently to shift the cassette holder to a position where the monochromatic ribbon cassette is located at the printing position, a base plate is attached detachably to the carriage, and an unlocking member for retracting the detent from the cam, and the driving means are provided on the base plate.

4. A ribbon shifting device for a printing apparatus, according to claim 1, wherein the driving means is a step motor.

5. A ribbon shifting device for a printing apparatus, according to claim 4, wherein a plurality of stalling sections for locating the cassette holder at positions where a plurality of the color zones are located at the printing position, respectively, are formed in the cam, and the length of each stalling section corresponds to a plurality of steps of turning of the output shaft of the step motor.

* * * * *